US006374902B1

(12) United States Patent
Vendeville et al.

(10) Patent No.: US 6,374,902 B1
(45) Date of Patent: Apr. 23, 2002

(54) METHOD FOR STARTING CONTINUOUS METAL CASTING OPERATION

(75) Inventors: Luc Vendeville, Bethune; Yann Breviere, Ecquedecques; Georges Mercier, Ham en Artois; Gilles Fellus, Marines; Michel Abi Karam, Courbevois; Yves René Leclercq, Etang la Ville, all of (FR)

(73) Assignees: Usinor, Puteaux (FR); Thyssen Stahl Aktiengesellschaft, Duisburg (DE)

( * ) Notice: Subject to any disclaimer, the term of this patent is extended or adjusted under 35 U.S.C. 154(b) by 0 days.

(21) Appl. No.: 09/462,154

(22) PCT Filed: Jul. 1, 1998

(86) PCT No.: PCT/FR98/01401

§ 371 Date: Mar. 13, 2000

§ 102(e) Date: Mar. 13, 2000

(87) PCT Pub. No.: WO99/03619

PCT Pub. Date: Jan. 28, 1999

(30) Foreign Application Priority Data

Jul. 16, 1997 (FR) ..... 97 09241

(51) Int. Cl.[7] ..... B22D 11/18; B22D 11/08

(52) U.S. Cl. ..... 164/453; 164/483; 164/449.1; 164/154.5

(58) Field of Search ..... 164/483, 4.1, 451, 164/452, 453, 454, 457, 150.1, 151, 151.1, 151.2, 151.3, 154.1, 154.2, 154.3, 154.4, 154.5, 154.8, 155.1, 155.2, 155.4, 155.5, 156.1, 157, 413, 449.1, 450.1

(56) References Cited

U.S. PATENT DOCUMENTS

| | | | | | |
|---|---|---|---|---|---|
| 4,770,230 | A | * | 9/1988 | Tinnes et al. | 164/483 |
| 4,771,821 | A | * | 9/1988 | Matsushita et al. | 164/452 |
| 4,774,999 | A | * | 10/1988 | Kraus | 164/453 |
| 5,174,361 | A | * | 12/1992 | Kursfeld | 164/453 |
| 5,311,924 | A | * | 5/1994 | Asano et al. | 164/453 |
| 5,409,054 | A | * | 4/1995 | Moriceau | 164/453 |
| 5,913,357 | A | * | 6/1999 | Hanazaki et al. | 164/453 |
| 5,918,662 | A | * | 7/1999 | Tezuka et al. | 164/453 |

FOREIGN PATENT DOCUMENTS

| | | | | | |
|---|---|---|---|---|---|
| DE | 34 21 344 | A1 | * | 12/1985 | B22D/11/18 |
| DE | 39 37 752 | A1 | * | 5/1991 | B22D/11/16 |
| FR | 2 698 806 | A1 | * | 6/1994 | B22D/11/10 |
| JP | 56-68570 | A | * | 6/1981 | B22D/11/16 |

* cited by examiner

*Primary Examiner*—M. Alexandra Elve
*Assistant Examiner*—Kevin P. Kerns
(74) *Attorney, Agent, or Firm*—Nixon Peabody LLP; Thomas W. Cole

(57) ABSTRACT

The process is characterized in that, before starting casting, an initialization position is determined for the stopper rod control actuator when the stopper rod is resting on its seat under its own weight and after having filled the tundish equipped with this stopper rod, the actuator is operated to place it in a controlled superclosed position and, to start casting, the actuator is driven according to an imposed movement versus time law, time (t1) for start of casting being determined from this law and the control actuator continues to be driven in opening direction to enable the metal to flow into the ingot mould.

6 Claims, 1 Drawing Sheet

METHOD FOR STARTING CONTINUOUS METAL CASTING OPERATION

BACKGROUND OF THE INVENTION

This invention concerns the continuous casting of metals, especially steel, and more particularly a process for starting casting from a situation where the casting installation is ready to receive the molten metal contained in a transport receptacle such as a casting ladle.

Such an installation conventionally includes a tundish equipped with a nozzle and an ingot mould. The tundish also includes blocking means, called a stopper rod, to block the nozzle and adjust the flow rate of the molten metal during casting.

Before starting casting, a dummy bar is placed in the installation; this dummy bar includes a dummy bar head which is inserted into the ingot mould to temporarily close the mould at the start of casting, and the stopper rod is placed in a closed position.

To start casting, the metal in the ladle is poured into the tundish.

Then, the stopper rod is opened so that the metal can fill the ingot mould by flowing through the nozzle. When the metal reaches a predetermined level in the ingot mould, the dummy bar is driven downwards to start the extraction of the cast product at least partially solidified as it comes into contact with the cooled walls of the ingot mould.

One of the problems is to define the time when extraction will be started especially on account of the level required in the ingot mould and the time required to obtain a sufficiently solidified product before starting extraction. Now, the arrival of the metal at a required level in the ingot mould depends on the flow rate of the metal in the nozzle and therefore especially on the stopper rod opening position.

Consequently, to automate startup, it is already known to use a level detector to detect the arrival of the metal at the required level in the ingot mould and to control the start of the extraction by this detector.

In addition, it is also known to use a level detector placed on the ingot mould to control the flow rate or the extraction speed during casting so as to conserve metal level more or less constant in the ingot mould throughout the casting process.

However, these detectors can only be placed at the top of the ingot mould. Also, their detection distance is conventionally low and they are positioned so as to measure the variations in level in the vicinity of the reference level during casting. Therefore, they only detect the metal in the ingot mould when the metal is approaching the reference level. Thus, during almost the complete ingot mould filling time, the level of the metal cannot be controlled. In addition, when the detector can finally detect the presence of the metal, and therefore command startup of extraction, a certain time is required before extraction is stabilized and level of metal may pass well beyond the reference level. This can be avoided in part by simultaneously commanding the closing of the stopper rod to reduce the supply rate. However, the stopper rod reaction time, positioning of which is ensured by an actuator, cannot be sufficiently reduced to totally avoid the above mentioned problem. Also, the inertia of the flowing metal and that of the stopper rod control means leads to fluctuations in the level which may last for a certain time before regulation, and therefore the level, are stabilized and casting becomes uniform.

Another problem which arises is the ability to determine the effective casting start time, that is, the time when the metal contained in the tundish starts to flow when the opening of the stopper rod is commanded. This problem is also related to that of being able to control the rise in level in the ingot mould, this level being undetectable during a major part of the filling operation as we saw previously. The only means for controlling this rise in level is therefore to act on the flow rate of the metal flowing from the tundish which depends on the exact position of the stopper rod. However, the position of the stopper rod is conventionally determined by a measuring device located on the stopper rod control means and not on the stopper rod itself. The result is that the indication given by these measuring means is not exactly representative of the position of the stopper rod itself this being due mainly to the inevitable plays in the mechanical means connecting the stopper rod to its control means. Therefore, not only is there a time lag between the stopper rod opening command and the start of real opening and therefore start of metal flow but also consequently indication of stopper rod position does not exactly reflect its effective position which determines the metal flow rate. However, it is only by knowledge of the exact casting start time, and of the flow rate, that the level in the ingot mould during filling can be accurately determined.

This problem is especially troublesome for the continuous casting process between rolls as determining the exact time of start of extraction is of prime importance for this technique. It is therefore necessary to accurately know the exact time of start of flow and the filling flow rate especially as, in this technique, the filling time between start of flow and start of extraction is very short.

SUMMARY OF THE INVENTION

The purpose of this invention is to solve the various above mentioned problems and in particular to allow effective casting start time and casting flow rate during the ingot mould filling phase to be accurately determined.

With these targets in mind, the subject of the invention is a starting process for a continuous metal casting operation in a casting installation including a tundish which includes an outlet hole which can be blocked by a stopper rod bearing on a stopper rod seat, mechanical connecting means between the stopper rod and a stopper rod control actuator, and an ingot mould receiving the metal flowing through the said hole.

According to the invention, this process is characterized in that, before starting casting:

a) the stopper rod is placed on its seat under the effect of its weight alone, the control cylinder being inactive and in an initialization position defined by the position of the stopper rod, b) the said initialization position of the control actuator is determined, c) the control actuator is driven in closing direction to push the stopper rod onto its seat, d) the tundish is filled with liquid metal, e) the control actuator is operated to place it in a controlled superclosed position defined by a predetermined distance of the position of control actuator in relation to initialization position, and, to start casting:

f) the control actuator is driven in opening direction according to an imposed and predefined control actuator movement versus time law, casting start time being determined from this law, by calculating, with this law, the time taken by the control actuator to move from superclosed position to the initialization position, g) and operation of the control actuator is continued in the opening direction to allow the metal to flow into the ingot mould.

As will be better understood later, the process according to the invention enables the time when the molten metal will start to flow between the stopper rod and its seat to be accurately determined.

This time is therefore exactly the moment when the stopper rod leaves its seat.

Theoretically, it would be sufficient to hold the stopper rod exactly in this position and to start to move it upwards to move it away from its seat, the exact time of start of movement defining casting start time.

However, in practice, this is impossible. Indeed, because of the inevitable plays existing in the mechanical connecting means between the stopper rod and the control actuator, and because of the thrust exerted on the stopper rod by the liquid metal contained in the tundish, it is clear that, even if the control actuator was held in a fixed so-called initialization position where the stopper rod just rests on its seat, the exact position of the stopper rod will vary when the tundish is filled with molten metal, especially due to the taking up of the mechanical plays and to the expansion phenomena.

The result would be that the tightness of the stopper rod on its seat would no longer be ensured and unwanted molten metal flows could occur before the tundish is filled.

To avoid this, conventionally according to the earlier technique, the operator operates the stopper rod control actuator before the tundish starts to fill, to forcibly press the stopper rod onto its seat. It is then practically impossible for the operator to exactly know when the stopper rod will be in the tightness limit position on its seat, when he will operate the control actuator in the opposite direction, as there is no exact correspondence between the position of the control actuator and the position of the stopper rod.

The principle of the invention is in fact to artificially reestablish this correspondence starting with the idea that, although there is no exact correspondence between the respective positions of the stopper rod and the control actuator when the control actuator is driven in one direction and then in another, this correspondence is however reestablished if we consider movement in only one direction, that is in the opening direction.

For this, according to the invention, an exactly measurable and therefore reproducible position of the control actuator is defined, called the controlled superclosed position, together with a control actuator movement law in the opening direction, that is corresponding to an upward movement of the stopper rod.

The controlled superclosed position is defined by a pre-established distance considered from the control actuator position which just causes the stopper rod to separate from its seat, that is the initialization position.

It can be seen that this initialization position of the control actuator is not defined by the operator or by any action on the said actuator but that it results only from the forces of gravity exerted on the installation and, in particular, on the stopper rod. It is therefore only the contact of the stopper rod on its seat, under its own weight, which defines the initialization position of the control actuator. It can therefore be seen that, when the initialization position is determined, it is the stopper rod which fixes the position of the control actuator whereas, during casting, it is obviously the control actuator which fixes the position of the stopper rod.

The actuator movement versus time control law is defined experimentally, according to the characteristics of the casting installation and the process, so as to establish a well-defined relation between the movement of the control actuator and the movement of the stopper rod as soon as, moving upwards, the stopper rod is no longer in contact with its seat. However, before this time, there is no such well-defined relation but only a definition of the position of the control actuator versus time, without the actual position of the stopper rod being related to that of the actuator.

This law will therefore enable and ensure a movement of the actuator, without there being a proportional movement of the stopper rod, this movement of the actuator corresponding, in a way, to the releasing of the stresses generated by the force pressing the stopper rod onto its seat.

Then, when the stresses are eliminated, that is from the time the stopper rod leaves its seat, the movement of the actuator leads to a movement of the stopper rod and therefore to the flow of the metal contained in the tundish, the flow rate of the molten metal then being controlled by acting on the actuator and dependent on the position of the said actuator.

The explanation above is intended to describe the principle of the invention and is therefore fairly theoretical. In practice, it is obvious that the actual start of flow does not exactly correspond to the time when the stopper rod leaves its seat, especially because the geometry of the surfaces in contact is not ideal and that the physical characteristics of the molten metal (fluidity, surface tension, etc.) enter into effect. This is why the actuator movement law is determined experimentally, one of the goals targeted by the invention being essentially to be able to ensure reproducibility of the starting conditions from one casting to another.

According to a specific arrangement of the invention, the stopper rod is pushed onto its seat until the thrust force exerted by the control means reaches a predetermined value.

Alternatively, the stopper rod is pushed onto its seat until the control means reach a predetermined position.

Whatever the case, the thrust exerted on the stopper rod before the introduction of the molten metal into the tundish must be sufficient to guarantee perfect tightness of the stopper rod on its seat without risk of this tightness being disturbed during the filling of the tundish. However, this superclosed position will be located beyond the controlled superclosed position in the closing direction.

According to another additional arrangement, when casting is started and after the control means have been set to initialization position, automatic opening of the stopper rod is continued according to an imposed opening law up to the so-called filling position. This filling position is maintained throughout the filling of the ingot mould. This arrangement in fact enables the filling of the ingot mould to be ensured under a controlled flow rate so that the rising of the liquid metal in the ingot mould is achieved as calmly as possible and the conventionally known level regulation can be brought into play smoothly, without creating surges, when the metal level in the ingot mould reaches a level near to the nominal level. This especially avoids all risks of the metal overflowing from the ingot mould. This also ensures smooth transition between the starting phase, that is until the level in the ingot mould is more or less equal to the nominal level, and start of extraction.

According to yet another preferential arrangement, before the level of the metal in the ingot mould reaches the predetermined nominal casting level, level regulation is activated to ensure the regulation of the level as soon as the level of the metal reaches a level near to the nominal level. Level regulation, well known in continuous casting installations, is therefore set into service well before the level of the metal can be detected by the sensor conventionally used in regulation systems. However Regulation is saturated to prevent it from tending to cause additional opening of the stopper rod (which normally would be the case as the level of the metal is then well under the normal level) . However, as the regulation circuits are already operating before the sensor detects the metal poured into the ingot mould, the regulation system acts without delay as soon as the level of the metal is detected. The result is that the reaction, caused by the said regulation when the poured in metal reaches a level near to the nominal level, is less sharp and does not generate a sudden movement of the stopper rod or a sudden variation in extraction speed.

Other advantages and features will appear in the description which will follow of a starting process for a continuous steel casting installation in compliance with the invention.

BRIEF DESCRIPTION OF THE DRAWINGS

Refer to appended drawings on which.

DETAILED DESCRIPTION OF THE PREFERRED EMBODIMENTS

Figure 1:
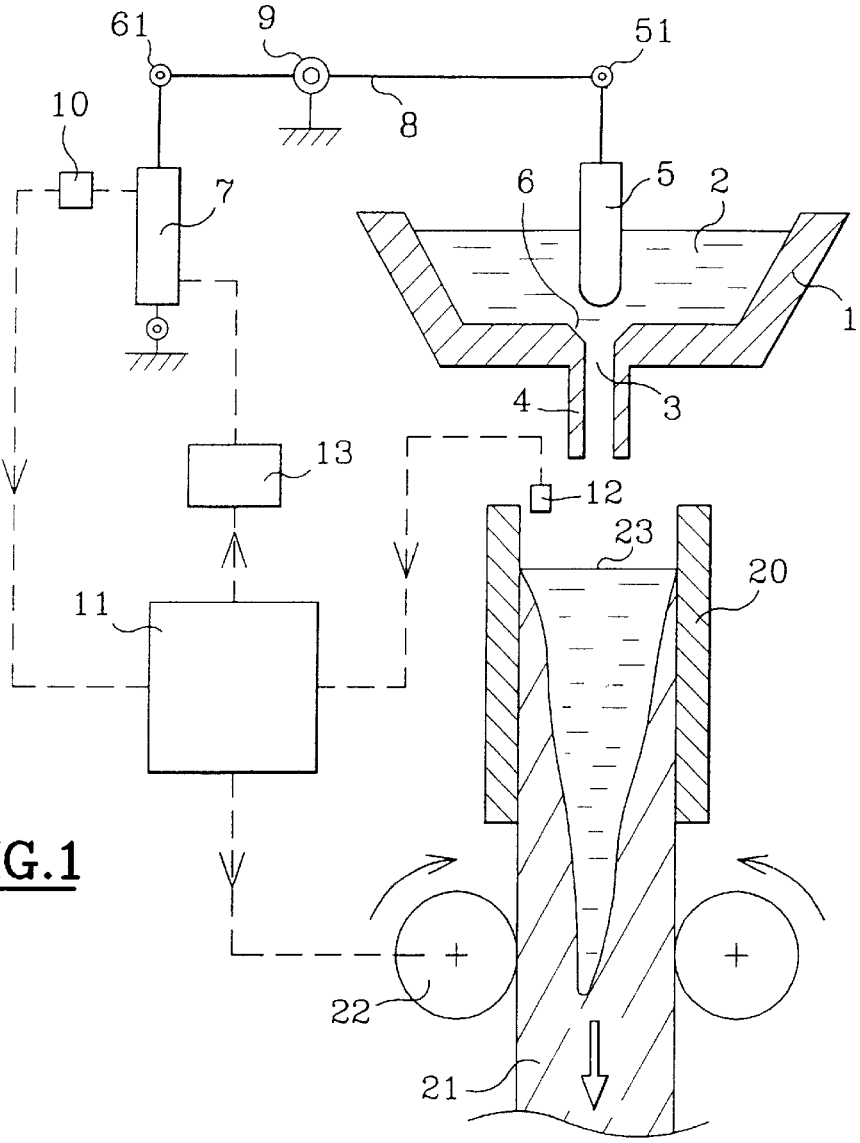
FIG. 1 shows a schematic view of an ingot mould continuous steel casting installation.

The continuous casting installation, shown on FIG. 1, during casting, includes a tundish 1, containing molten steel 2, equipped with an outlet hole 3 with a nozzle 4. The outlet hole 3 can be blocked by a stopper rod 5 when it bears on its seat 6. The movements of the stopper rod are made by a control actuator 7, connected to the stopper rod 5 by mechanical connecting means such as a lever 8 hinged so as to pivot in a bearing 9.

The installation also includes, in a manner known itself, an ingot mould 20 the walls of which are vigorously cooled to cool and solidify the molten metal poured into the ingot mould through the nozzle 4. At normal casting speed, the metal at least partially solidified in the form, for example, of a slab 21, is extracted from the ingot mould via the bottom, using extraction rolls 22 rotated by motors not shown.

The control actuator 7 is equipped with a position sensor 10 which permanently measures the exact position of the actuator rod. The installation also includes a regulation system 11, shown schematically on the drawing and which is also connected to a level detector 12 to detect and measure level 23 of the metal in the ingot mould.

The regulation system 11 is also connected to a solenoid valve 13, or to equivalent control means, to control the movements of the actuator 7, and to the motors of the extraction rolls 22 to control their speed.

All these means are conventionally known in existing casting installations.

Note, however, that control actuator means not only a conventional actuator including a rod movable in translation in an actuator body, such as the actuator 7 shown in FIG. 1, but also any other actuator which can ensure the same stopper rod movement function.

Figure 2:
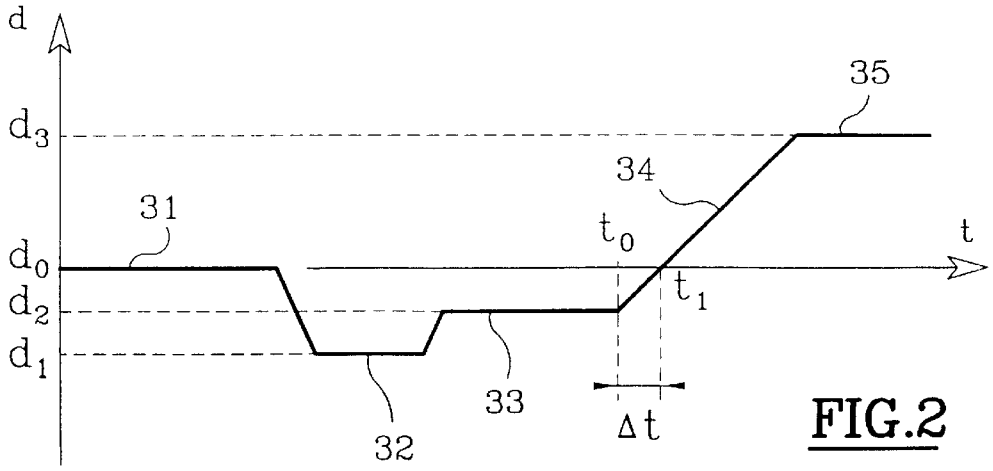
FIG. 2 is a graph showing the measured position of the stopper rod control actuator versus time.

The graph in FIG. 2 shows, as an example of the process according to the invention, the variations in position d of the actuator 7 versus time t from a time before the start of the process until a normal casting speed is reached.

The plot 31 corresponds to the initialization position "0" of the control actuator, that is the measured position of the actuator rod when the stopper rod 5 is resting under its own weight on its seat 6. The actuator is then submitted to no pressure from the solenoid valve 13, the position of the rod being determined only by the position of the stopper rod 5. In the example shown, it is easy to understand that the weight of the stopper rod and that of the actuator rod exert downward loads on the lever 8 and that, consequently, the inevitable plays in all the hinge points are at the top for the hinge points 51 and 61 of the stopper rod and the actuator rod on the lever and for the hinge point of pivot 9 of the lever on the installation.

From this position, the actuator is then driven so that its rod moves by a value d1, so as to compensate for the various plays mentioned above and to forcibly press the stopper rod onto its seat. This position is conserved throughout the time the tundish is filled with metal as shown on plot 32. Instead of defining, at this stage, a position of the actuator d1, an actuator supply pressure or load could also be defined as was already stated.

When the tundish is full, the actuator is then driven to move the rod to the so-called controlled superclosing position (plot 33 in FIG. 2). This position is defined by a distance d2 from the initialization position. This distance can be for example a predetermined percentage, for example 3%, of the total stroke of the actuator. This distance will in practice be determined experimentally so that it will not be too high but, however, sufficient so that the stopper rod remains adequately pressed onto its seat so that no play appears at the various hinge points.

This position will then be considered as the actuator control start point under the already mentioned imposed opening law.

This law is shown in FIG. 2 by plot 34. This law, as represented, fixing the movement of the actuator rod versus time, is linear. This is however not mandatory, the curve representative of the said law could deviate somewhat from a straight line according to the kinematics of the connecting means between the actuator and the stopper rod and also the ingot mould filling rate conditions as will be seen later.

Therefore, knowing the actuator movement law, the distance d2 and the time to at which actuator movement is controlled in compliance with this law, the accurate starting time t1 will be determined by calculation as being time to+$\Delta$t, $\Delta$t being the time taken for the actuator rod to move over the distance d2. At this time, the movement of the actuator will have released the pressure exerted by the stopper rod on its seat during the controlled superclosing phase and will have thus taken up all hinge point plays in the direction opposite to the one produced during the pressurization of the actuator before filling the tundish. The actuator, lever and stopper rod assembly is then more or less in the same situation as during initialization because the forces exerted are practically the same as those exerted during initialization, the only difference being that it is the actuator which pulls the stopper rod upwards whereas, during initialization, it is the stopper rod which retains the actuator.

From time t1, the flow outlet hole therefore opens gradually, the opening operation being controlled by the movement of the actuator, this continuous movement being made under the control of the imposed law up to a point defined by distance d3, this distance d3 being determined so as to correspond to a given opening of the stopper rod. It may be different from the maximum opening provided for the normal casting speed which will only be reached after extraction has been started. From time ti, the metal contained in the tundish therefore begins to flow into the ingot mould at a flow rate determined by the opening of the stopper rod, that is gradually increasing until the actuator reaches position d3, then stabilizing at an imposed value whilst the filling of the ingot mould continues (plot 35).

During the time the ingot mould is filled, before extraction starts, the metal flow rate can therefore be different from the nominal flow rate under which the metal will flow from the tundish into the ingot mould after the startup of the extraction rolls. It is only when the level of metal in the ingot mould reaches a level near to level detector 12 that level regulation, of a type known itself, takes over to control the actuator 7, and possibly the speed of the extractor rolls 22, to adapt the flow rate to the extraction speed so as to conserve a more or less constant level of metal in the ingot mould as is well known.

The invention is not limited to the starting process described here above only as an example. In particular, the process according to the invention could be advantageously used in continuous casting installations between rolls.

Also, instead of using the sensor 10 directly placed on the actuator and measuring the position of the rod, the position measurements could be made by any other measuring means suitable to accurately determine the position of the stopper rod control means.

What is claimed is:

1. A starting process for a continuous metal casting operation in a casting installation including a tundish with an outlet hole which can be blocked by a stopper rod which bears on a stopper rod seat, mechanical connecting means between the stopper rod and a stopper rod movement control actuator, and an ingot mould receiving the metal flowing through the said outlet hole, characterized in that, before starting casting:

a) the stopper rod is placed on its seat under the effect of only its own weight, the control actuator being inactive and in an initialization position defined by the position of the stopper rod, b) the said initialization position of the control actuator is determined, c) the control actuator is then driven in the closing direction to force the stopper rod onto its seat until a thrust force exerted on the control actuator reaches a predetermined value, the control actuator being then in a superclosed position located a first distance from the initialization position, d) the tundish is filled with liquid metal, e) the control actuator is driven to place the control actuator in a controlled superclosed position defined by a predetermined second distance of the position of the control actuator in relation to the initialization position, the predetermined second distance being less than the first distance, and, to start casting:

f) the control actuator is driven in the opening direction according to an imposed control actuator movement versus time law, the time for start of casting being determined from this law by calculating, with this law, the time taken by the control actuator to move from the controlled superclosed position to the initialization position, g) and the control actuator continues to be driven in an opening direction to enable the metal to flow into the ingot mould.

2. A starting process for a continuous metal casting operation in a casting installation including a tundish with an outlet hole which can be blocked by a stopper rod which bears on a stopper rod seat, mechanical connecting means between the stopper rod and a stopper rod movement control actuator, and an ingot mould receiving the metal flowing through the said outlet hole, characterized in that, before starting casting:

a) the stopper rod is placed on its seat under the effect of only its own weight, the control actuator being inactive and in an initialization position defined by the position of the stopper rod, b) the said initialization position of the control actuator is determined, c) the control actuator is then driven in the closing direction to push the stopper rod onto its seat until the control actuator reaches a predetermined superclosed position defined by a predetermined first distance in relation to the initialization positions, d) the tundish is filled with liquid metal, e) the control actuator is driven to place the control actuator in a controlled superclosed position defined by a predetermined second distance of the position of the control actuator in relation to the initialization position, the predetermined second distance being less than the predetermined first distance, and, to start casting:

f) the control actuator is driven in the opening direction according to an imposed control actuator movement versus time law, the time for start of casting being determined from this law by calculating, with this law, the time taken by the control actuator to move from the controlled superclosed position to the initialization position, and the control actuator continues to be driven in an opening direction to enable the metal to flow into the ingot mould.

3. Process in accordance with claim 1, characterized in that, during the starting of the casting and after the control actuator has been set to the initialization position, the stopper rod opening is continued up to a filling position located below a full opening position, this filling position being maintained during the filling of the ingot mould.

4. Process in accordance with claim 3, characterized in that, before the level of the metal in the ingot mould reaches a nominal predetermined casting level, a level regulation system is activated which controls the level as soon as the level of the metal reaches a level near the nominal level.

5. Process in accordance with claim 2, characterized in that, during the sting of the casting and after the control actuator has been set to the initialization position, the stopper rod opening is continued up to a filling position located below a fill opening position, this filling position being maintained during the filling of the ingot mould.

6. Process in accordance with claim 5, characterized in that, before the level of the metal in the ingot mould reaches a nominal predetermined casting level, a level regulation system is activated which controls the level as soon as the level of the metal reaches a level near to the nominal level.

* * * * *

UNITED STATES PATENT AND TRADEMARK OFFICE

CERTIFICATE OF CORRECTION

PATENT NO. : 6,374,902 B1 
DATED : April 23, 2002
INVENTOR(S) : Luc Vendeville, Yann Breviere, Georges Mercier, Gilles Fellus, Michel Abi Karam and Yves Rene Leclercq It is certified that error appears in the above-identified patent and that said Letters Patent is hereby corrected as shown below:

Column 8,
Line 51, please delete "sting" and insert -- starting --.

Signed and Sealed this

Twenty-third Day of July, 2002

*Attest:*

*Attesting Officer*

JAMES E. ROGAN
*Director of the United States Patent and Trademark Office*